US007607889B2

(12) United States Patent
Baldauf et al.

(10) Patent No.: US 7,607,889 B2
(45) Date of Patent: Oct. 27, 2009

(54) TURBINE BLADE AND GAS TURBINE EQUIPPED WITH A TURBINE BLADE

(75) Inventors: Stefan Baldauf, Ismaning (DE); Hans-Thomas Bolms, Mülheim an der Ruhr (DE); Michael Händler, Erkrath (DE); Christian Lerner, Herten (DE)

(73) Assignee: Siemens Aktiengesellschaft, Munich (DE)

( * ) Notice: Subject to any disclaimer, the term of this patent is extended or adjusted under 35 U.S.C. 154(b) by 433 days.

(21) Appl. No.: 10/586,462

(22) PCT Filed: Jan. 12, 2005

(86) PCT No.: PCT/EP2005/000223

§ 371 (c)(1),
(2), (4) Date: Jul. 14, 2006

(87) PCT Pub. No.: WO2005/068785

PCT Pub. Date: Jul. 28, 2005

(65) Prior Publication Data

US 2008/0232956 A1 Sep. 25, 2008

(30) Foreign Application Priority Data

Jan. 20, 2004 (EP) ..... 04001107

(51) Int. Cl.
*F01D 5/18* (2006.01)
*F01D 5/22* (2006.01)

(52) U.S. Cl. ..... 416/97 R; 415/115; 416/175

(58) Field of Classification Search ..... 415/115, 415/116, 117, 175, 177, 178; 416/95, 96 R, 416/97 R See application file for complete search history.

(56) References Cited

U.S. PATENT DOCUMENTS

| | | | | |
|---|---|---|---|---|
| 3,389,889 | A * | 6/1968 | Penny | 416/92 |
| 3,446,481 | A | 5/1969 | Kydd | |
| 3,950,113 | A * | 4/1976 | Albrecht | 416/97 A |
| 4,457,668 | A * | 7/1984 | Hallinger | 416/95 |
| 4,734,010 | A | 3/1988 | Bättig | |
| 5,244,345 | A | 9/1993 | Curtis | |
| 6,398,499 | B1 * | 6/2002 | Simonetti et al. | 416/193 A |
| 2004/0258528 | A1 | 12/2004 | Goga et al. | |

FOREIGN PATENT DOCUMENTS

| | | |
|---|---|---|
| CH | 291 898 | 10/1953 |
| DE | 579 989 | 6/1933 |
| DE | 26 28 807 A1 | 1/1977 |
| EP | 1 073 827 B1 | 2/2001 |
| FR | 2 831 207 A1 | 4/2003 |

* cited by examiner

*Primary Examiner*—Igor Kershteyn

(57) ABSTRACT

The invention relates to a turbine blade comprising a vane that runs along a blade axis and a platform region, which is located at the root of the vane having a platform that extends transversally to the blade axis. The aim of the invention is to configure a delimitation of a flow channel of a gas turbine in the simplest possible manner. Therefore, the platform is configured by an elastic sheet metal part that rests on the vane. Said part leads to a gas turbine comprising a flow conduit that runs along an axis of the gas turbine, said conduit having an annular cross-section for a working medium and a second vane stage that is situated downstream of a first vane stage, which runs along the axis.

20 Claims, 2 Drawing Sheets

TURBINE BLADE AND GAS TURBINE EQUIPPED WITH A TURBINE BLADE

CROSS REFERENCE TO RELATED APPLICATIONS

This application is the US National Stage of International Application No. PCT/EP2005/000223, filed Jan. 12, 2005 and claims the benefit thereof. The International Application claims the benefits of European Patent application No. 04001107.4 filed Jan. 20, 2004. All of the applications are incorporated by reference herein in their entirety.

FIELD OF THE INVENTION

The invention relates to a turbine blade with a blade leaf arranged along a blade axis and with a platform region, which, arranged at the foot of the blade leaf, has a platform extending transversely with respect to the blade axis. The invention applies, furthermore, to a gas turbine with a flow duct extending along an axis of the gas turbine and having an annular cross section for a working medium, and a second blade stage arranged downstream of a first along the axis, a blade stage having a number of annularly arranged turbine blades extending radially into the duct.

BACKGROUND OF THE INVENTION

In a gas turbine of this type, temperatures which may lie in the range of between 1000° C. and 1400° C. arise in the flow duct after it has been acted upon by hot gas. The platform of the turbine blade, as a result of the annular arrangement of a number of such turbine blades in a blade stage, forms part of the flow duct for a working fluid in the form of hot gas which flows through the gas turbine and thereby drives the axial turbine rotor by the turbine blades. Such high thermal stress on the flow duct boundary formed by the platforms is counteracted in that a platform is cooled from the rear, that is to say from a turbine blade foot arranged below the platform. For this purpose, the foot and the platform region conventionally have suitable ducting so as to be acted upon by a cooling medium.

An impact-cooling system for a turbine blade of the type initially mentioned may be gathered from DE 2 628 807 A1. In DE 2 628 807 A1, for cooling of the platform, a perforated wall element is arranged upstream of that side of the platform which faces away from the hot gas, i.e. downstream of the platform, that is to say between a blade foot and the platform.

Cooling air under relatively high pressure impinges through the holes of the wall element onto that side of the platform which faces away from the hot gas, with the result that efficient impact cooling is achieved.

EP 1 073 827 B1 discloses a novel way of designing the platform region of cast turbine blades. The platform region is designed as a double platform consisting of two platform walls lying opposite one another. What is achieved thereby is that the platform wall directly exposed to the flow duct and therefore to the hot gas and delimiting the flow duct can be made thin. The design in the form of two platform walls results in functional separation for the platform walls. The platform wall delimiting the flow duct is responsible essentially for the ducting of hot gas. The opposite platform wall not acted upon by the hot gas takes over the absorption of the loads originating from the blade leaf. This functional separation allows the platform wall delimiting the flow duct to be made so thin that the ducting of the hot gas is ensured, without substantial loads in this case having to be absorbed.

In the design of the turbine blade of the type initially mentioned, in a parting plane between platforms of turbine blades of the same blade stage which are contiguous or of adjacent turbine blades of blade stages arranged one behind the other, sealing measures are necessary in order to prevent an unwanted and excessive outflow of cooling medium into the flow duct acted upon by hot gas. The measures required for sealing off may lead to difficult situations in structural and cooling terms on a platform wall subjected to high thermal load and constitute an increased potential for the failure of a turbine blade and consequently of a gas turbine.

Conventionally, the sealing off of such parting planes is achieved by the installation of special sealing elements. However, on the one hand, these have to be sufficiently flexible to permit simultaneous relative movements of adjacent parts, in particular of adjacent turbine blades and their platforms, and, on the other hand, they must nevertheless maintain a sealing action. The installation of such sealing elements leads to geometrically and structurally complicated components. As a result of this, special cooling measures are necessary so that platform edge regions where access is difficult can be cooled sufficiently.

It would be desirable to have a gas turbine in which the boundary of the flow duct is configured as simply as possible and at the same time can be cooled effectively and is sealed off.

SUMMARY OF THE INVENTION

This is where the invention comes in, the object of which is to specify a turbine blade with a platform, which at the same time is configured in a simple way and also advantageously satisfies the geometrically structural and cooling requirements within the framework of a flow duct boundary of a gas turbine. Furthermore, the sealing off of the parting planes between adjacent turbine blades is to take place particularly simply and cost-effectively.

As regards the turbine blade, the object is achieved by the invention by means of the turbine blade initially mentioned, in which, according to the invention, the platform is formed at least partially by a first resilient elastic sheet metal part which is fixed to the blade leaf and which can be laid against an adjacent turbine blade.

The invention proceeds from the consideration that the use of a platform which is not load-bearing for forming the boundary of a flow duct, acted upon by hot gas, of a gas turbine is fundamentally suitable for cooling the platform and consequently the boundary of the flow duct as effectively as possible. Beyond this, the essential recognition of the invention is that it is possible to equip the platform itself with an increased sealing action, specifically in that the platform is made thin-walled such that it is formed by a resilient elastic sheet metal part lying against the blade leaf.

To be precise, the platform, as a part delimiting the flow duct acted upon by hot gas, consequently fulfills all the requirements in terms of cooling and also of a sealing element. By resilient elastic sheet metal part being fixed to the blade leaf, to be precise, the platform as such is sufficiently flexible to permit simultaneous relative movements of adjacent blade leaves and of other parts, and nevertheless maintains the sealing action. This avoids the need for a special sealing element. This simplifies the configuration and cooling of the flow duct boundary.

According to the invention, the first resilient elastic sheet metal part is provided as a platform wall which is not load-bearing, which at least partially delimits the flow duct acted upon by hot gas. A load-bearing platform wall provided in EP 1 073 827 B1, which would be arranged downstream of the first resilient elastic sheet metal part, may largely be dispensed with. The platform therefore consists at least partially of the first resilient elastic sheet metal part fixed to the blade leaf.

The sealing element necessary hitherto between platforms of adjacent turbine blades may be dispensed with, since the first resilient elastic sheet metal part of one turbine blade lies sealingly against the other adjacent turbine blade.

The advantages as regards the cooling and sealing action of the first resilient elastic sheet metal part for the platform and consequently the flow duct boundary are preserved.

Advantageous developments of the invention can be gathered from the subclaims and specify in detail advantageous possibilities, in particular, for developing the platform in terms of the above object.

According to a particularly preferred development of the invention, there is provision for the platform to be formed by the first resilient elastic sheet metal part fixed to a first abutment on one side of the blade leaf and to be formed by a second sheet metal part fixed to a second abutment on the other side of the blade leaf. Consequently, two sheet metal parts are expediently provided, which form the platform and which therefore extend on both sides transversely with respect to the blade axis on one side of the blade leaf and the other.

Expediently, the second sheet metal part lying against the blade leaf assumes the function of a first platform wall not bearing the load of the blade leaf, and, furthermore, the platform has a second platform wall bearing the load of the blade leaf. In this refinement, appropriate cooling space for acting upon by cooling medium is formed between the first platform wall which is not load-bearing and which consists of the second sheet metal part and the second thicker load-bearing platform wall, as a special load-bearing structure.

According to a development of the invention, each abutment may be designed in the form of a groove or edge. This allows a particularly reliable and fluidically beneficial fastening of the sheet metal part to the foot of the blade leaf.

Within the scope of a preferred development of the invention, it has proved expedient for the sheet metal parts, in particular the first, to be held at a further abutment of an adjacent turbine blade. Expediently, this further abutment may be in the form of a bearing support.

For example, such a bearing support may be formed by a step integrally formed between the blade foot and the foot of the blade leaf. The first sheet metal part of a first turbine blade engages sealingly behind the bearing support of the turbine blade adjacent to this. The second sheet metal part may advantageously engage behind the bearing support arranged on the same turbine blade or, additionally or alternatively, may be attached to the step.

Expediently, in the state of rest, the first resilient elastic sheet metal part lies loosely against the further abutment of the adjacent turbine blade. In this case, a sufficient fastening, yet to be explained, of the sheet metal part arises from the movement or fluidic tie-up of the turbine blade in the operating state of a gas turbine.

The sealing action of the first resilient elastic sheet metal part on the further abutment may be further improved if the first resilient elastic sheet metal part lies against the further abutment under a self-generated prestress.

Furthermore, to achieve the object, the invention applies to a gas turbine mentioned initially, a blade stage having a number of annularly arranged turbine blades extending radially into the flow duct, in accordance with the invention a turbine blade being designed according to an abovementioned type.

Advantageous developments of the gas turbine may be gathered from the further subclaims and specify in detail advantageous possibilities, in particular, for designing the flow duct boundary and the function of the turbine blade within the framework of the flow duct boundary in accordance with the above object.

Within the framework of a first development, the turbine blade is a moving blade. Such a moving blade is fastened to an axially extending turbine rotor and rotates together with the turbine rotor during operation of the gas turbine. During the rotary operation of a turbine blade in the form of a moving blade on the turbine rotor, a centrifugal force acting from the foot of the blade leaf in the direction of the blade leaf is generated as a result of rotation. In this case, according to the development, the first resilient elastic sheet metal part achieves a sufficient sealing action between two mutually contiguous sheet metal parts of two adjacent moving blades. As a result of the centrifugal force, the first resilient elastic sheet metal part of a first moving blade is pressed against a further abutment of the second moving blade and is thereby laid in place, fastened by centrifugal force. That is to say, even in the event that the first resilient elastic sheet metal part lies loosely against the further abutment in the state of rest of the moving blade, the centrifugal force ensures that the resilient elastic sheet metal part lies sealingly against the moving blade in the operating state. When the moving blade of the gas turbine is in operation, the first resilient elastic sheet metal part thus also has the function of a sealing element. In this case, the lying surface of the first resilient elastic sheet metal part against the further abutment of the adjacent moving blade in the form of a bearing support advantageously acts as a sealing abutment for the first metal part. The penetration of hot gas flowing through the turbine through the gap formed hitherto between two platforms of adjacent moving blades can be avoided on account of the effective seal, as can an undesirably high leakage of coolant through the gap into the hot-gas space.

According to an alternative development of the gas turbine, the turbine blade is provided as a guide blade on the peripheral turbine casing. During the operation of a turbine blade in the form of a guide blade on the turbine casing, a pressure drop is generated by a cooling medium from the foot of the blade leaf in the direction of the blade leaf. In this case, the alternative development provides for the first resilient elastic sheet metal part of a first guide blade to be pressed due to the pressure drop against the further abutment of a second guide blade and thereby to be fastened by pressure. The pressure drop is thus generated in that the first resilient elastic sheet metal part is acted upon from the rear by cooling medium and is thereby pressed against the further abutment. For a guide blade, the pressure drop is sufficiently high, so that this not only suffices for a pressure fastening of the first resilient elastic sheet metal part against the further abutment, but, furthermore, when the guide blade in the gas turbine is in operation, the first resilient elastic sheet metal part has the function of a sealing element. The lying surfaces of the first resilient elastic sheet metal part act as sufficient sealing surfaces at an abutment explained above, and the abutment acts as an abutment for the first resilient elastic sheet metal part.

Within the framework of a refinement of the gas turbine, it proves advantageous that a flow duct boundary is continuously formed, between a first turbine blade and an adjacent second turbine blade of the same blade stage, by a first resilient elastic sheet metal part of the first turbine blade and by a second sheet metal part of the second turbine blade. Within a blade stage, a continuous radial boundary of the flow duct is thereby advantageously formed.

Within the framework of a further refinement of the gas turbine, it proves advantageous, furthermore, that a flow duct boundary is continuously formed, between a first turbine blade of the first blade stage and a second turbine blade of the second blade stage axially adjacent to the first turbine blade with respect to the rotor, by a first resilient elastic sheet metal part of the first turbine blade and by a second sheet metal part of the second turbine blade. A continuous boundary of the flow duct is thereby advantageously formed. Advantageously, the blade stages are guide blade stages and the turbine blades are guide blades.

Because of, the abovementioned types of continuous boundary, the parting planes, otherwise to be sealed off in the case of conventional boundaries of a flow duct of a gas turbine, and the then additionally required sealing elements are expended. The problems arising in connection with sealing elements are eliminated entirely on account of the continuous delimitation of the flow duct by means of the first resilient elastic sheet metal part and the second sheet metal part.

In this case, it proves expedient that a first resilient elastic sheet metal part arranged on a first turbine blade and a second sheet metal part arranged on a second turbine blade are held jointly at the further abutment of the first turbine blade. Details are explained in connection with the drawing.

BRIEF DESCRIPTION OF THE DRAWINGS

A particularly preferred exemplary embodiment of the invention is described below with reference to the drawing. This is not intended to illustrate the exemplary embodiment true to scale, on the contrary the drawing, where appropriate for an explanation, is in diagrammatic and/or slightly distorted form. As regards additions to the teachings which can be seen directly from the drawing, reference is made to the relevant prior art. In particular, in the drawing.

DETAILED DESCRIPTION OF THE INVENTION

Figure 1:
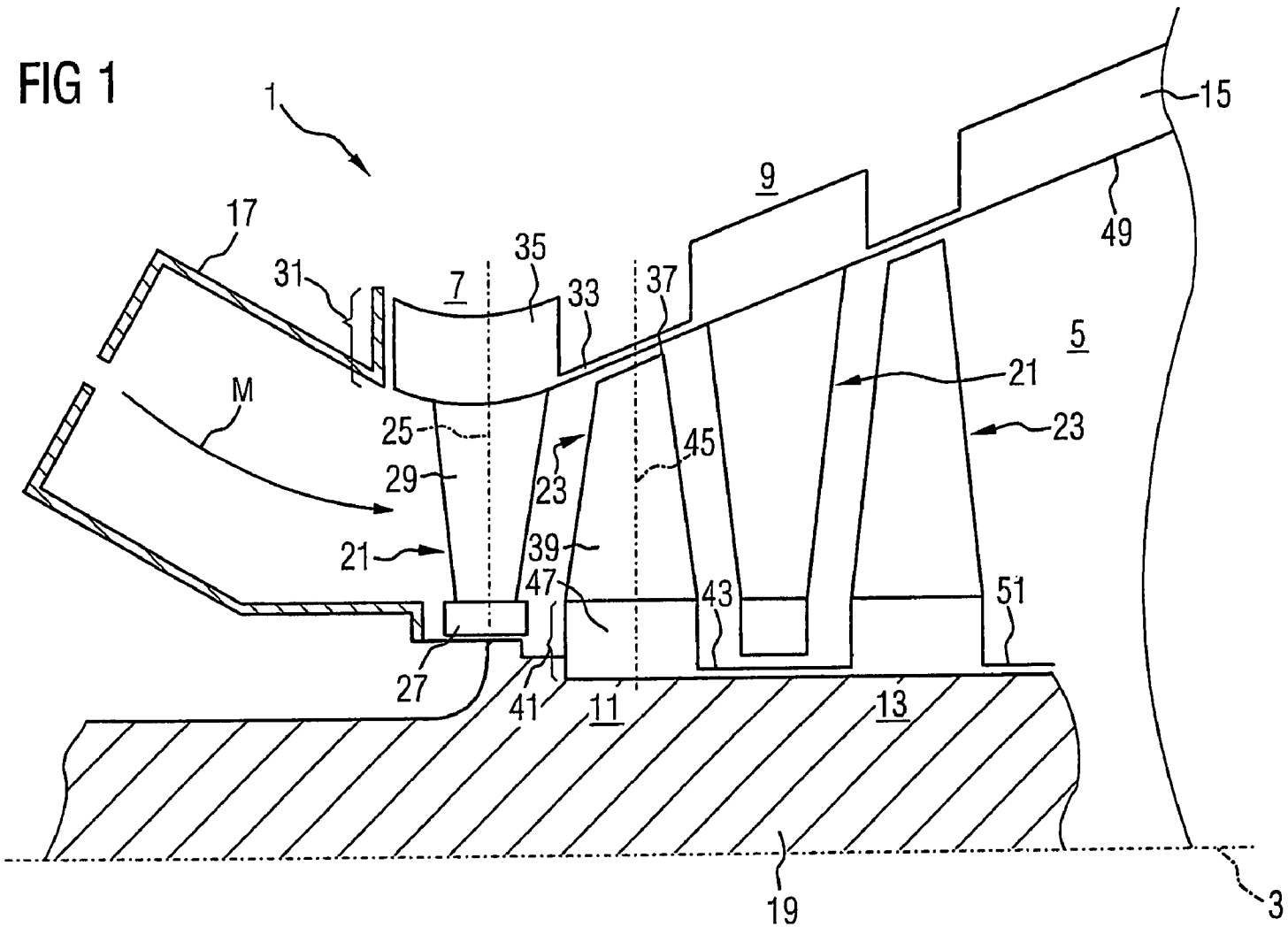
FIG. 1 shows a particularly preferred embodiment of a gas turbine with a flow duct and with a preferred version of the guide and moving blading in diagrammatic form in a cross-sectional view.

FIG. 1 shows a gas turbine 1 with a flow duct 5 extending along an axis 3 and having an annular cross section for a working medium M. A number of blade stages are arranged in the flow duct 5. In particular, a second guide blade stage 9 is arranged downstream of a first guide blade stage 7 along the axis 3. Furthermore, a second moving blade stage 13 is arranged downstream of a first moving blade stage 11. The guide blade stages 7, 9 in this case have a number of guide blades 21 arranged annularly on a peripheral turbine casing 15 and extending radially into the flow duct 5. A moving blade stage 11, 13 in this case has a number of moving blades 23 arranged annularly on an axial turbine rotor 19 and extending radially into the flow duct 5. The flow of a working medium M is in this case generated in the form of a hot gas by a burner 17. Correspondingly to the annular cross section of the flow duct 5, a number of such burners 17 are arranged around the axis 3 in an annular space not shown in the cross-sectional drawing of FIG. 1.

A guide blade 21 and a moving blade 23 are shown diagrammatically in FIG. 1. A guide blade 21 has a blade tip 27 arranged along a blade axis 25, a blade leaf 29 and a platform region 31. The platform region 31 has a platform 33 extending transversely with respect to the blade axis 25 and a blade foot 35.

A moving blade 23 has a blade tip 37 arranged along a blade axis, a blade leaf 39 and a platform region 41. The platform region 41 has a platform 43 extended transversely with respect to the blade axis 45 and a blade foot 47.

The platform 33 of a guide blade 21 and the platform 43 of a moving blade 23 thus form in each case part of a boundary 49, 51 of the flow duct 5 for the working medium M which flows through the gas turbine 1. The peripheral boundary 49 is in this case part of the peripheral turbine casing 15. The rotor-side boundary 51 is in this case part of the turbine rotor 19 rotating when the gas turbine 1 is in the operating state.

Figure 2:
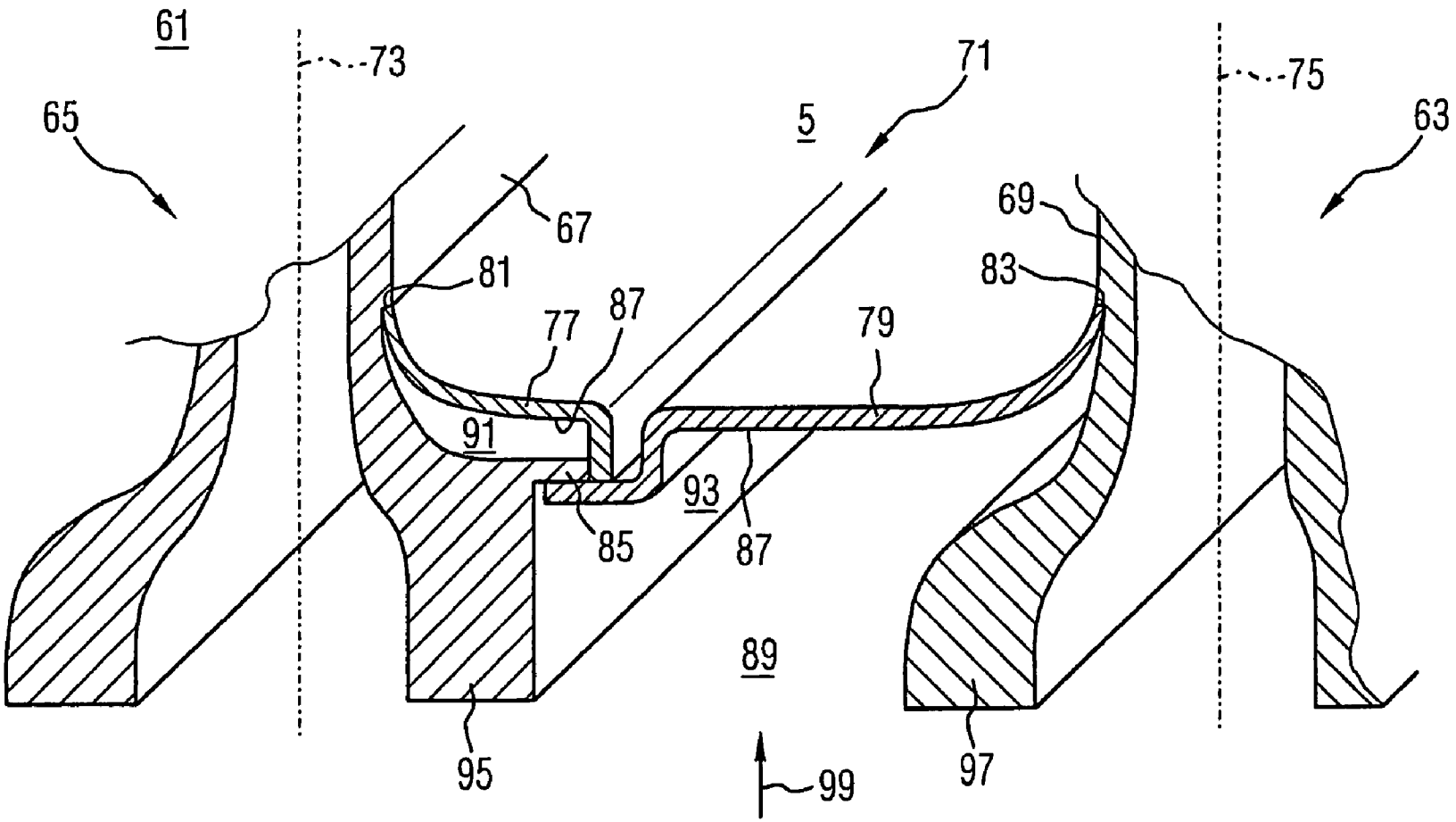
FIG. 2 shows a platform region of a particularly preferred embodiment of a first turbine blade of a first blade stage and of a second turbine blade, axially adjacent to the first turbine blade, of a second blade stage, in a perspective view.

As indicated diagrammatically in FIG. 1 and shown in detail in FIG. 2, in this case the platform 33 of a guide blade 21 and the platform 43 of a moving blade 23 are formed by sheet metal parts fixed to the blade leaf 29, 39.

FIG. 2 shows, to represent a platform region 31, 41, a platform region 61. The first turbine blade 63 and second turbine blade 65, shown in FIG. 2, in this case represents a first guide blade 21 of a first guide blade stage 7 and a second guide blade 21, arranged directly axially downstream of this, of a second guide blade stage 9. The first turbine blade 63 and the second turbine blade 65 also represent a first moving blade 23, shown in FIG. 1, of the first moving blade stage 11 and a second moving blade 23, directly arranged axially downstream of this, of the second moving blade stage 13. Preferably, however, the turbine blades 63, 65 are guide blades.

The first turbine blade 63 has a blade leaf 69 depicted in truncated form. The second turbine blade 65 in this case has a blade leaf 67 depicted in truncated form. In the case of the first turbine blade 63 and of the second turbine blade 65, the platform region 61 has formed in it, at the foot of the blade leaf 67, 69, a platform 71 which extends transversely with respect to the blade axis 73, 75. In this case, the platform 71 is formed, on the one hand, by a first resilient elastic sheet metal part 79 shown in the first blade 63 and, on the other hand, by a second sheet metal part 77 shown in the second blade 65. The first resilient elastic sheet metal part 79 is fastened to a first abutment 83 on one side of the blade leaf 69, this side being shown in the case of the first turbine blade 63. The second resilient elastic sheet metal part 77 is fastened to a second abutment 81 on the other side of the blade leaf 67, this side being shown in the case of the second turbine blade 65. The fastening may take place, for example, by welding or soldering and is in this case leak tight. The first abutment 83 and the second abutment 81 are in each case designed in the form of a groove, into which in each case the first resilient sheet metal part 79 and the second sheet metal part 77 butts in each case with its edge ending at the blade leaf 69 or at the blade leaf 67. Furthermore, the second resilient elastic sheet metal part 77 is held at a further abutment 85 of the second turbine blade 65. In the present embodiment, the second sheet metal part 77 is attached to the abutment 85. Alternatively or additionally, the second sheet metal part 77 could also engage behind the further abutment 85. The latter case applies to the first resilient elastic sheet metal part 79 of the first turbine blade 63, which sheet metal part is held jointly with the second sheet metal part 77 at the further abutment 85 of the second turbine blade 67. For this purpose, the first resilient elastic sheet metal part 79 engages loosely behind the further abutment 85. The further abutment 85 is designed in the form of a bearing support for holding the second sheet metal part 77 and the first resilient elastic sheet metal part 79 and thus forms, on its side facing the first resilient elastic sheet metal part 79, a sealing surface which serves as an abutment for the first resilient elastic sheet metal part 79.

A boundary 87 of the flow duct 5 is formed in the way outlined above between the first turbine blade 63 and the second turbine blade 65 by the first resilient elastic sheet metal part 79 of the first turbine blade 63 and by the second sheet metal part 77 of the second turbine blade 65, the boundary 87 being continuous. Thus, the use of a thin-walled platform 71 which is not load-bearing for producing the boundary 87 in the form of a second sheet metal part 77 and of a first resilient elastic sheet metal part 79 makes it possible at the same time for the sheet metal parts 77, 79 to act as a sealing element. A sealing element of this type is at the same time sufficiently flexible to allow relative movement of the adjacent first turbine blade 63 and second turbine blade 65, and nevertheless has a sufficient sealing action. This avoids the need for a sealing element, such as would have been necessary for the sealing off of parting planes in the case of hitherto conventional platforms lying opposite one another. Potentially high-risk, structurally and thermally unfavorable reception structures of such a sealing element are consequently avoided.

In the embodiment shown here, the platform 71 largely manages on its rear side 89 without a supporting structure or a load-bearing platform wall arrangement. Instead, on the rear side 89, a first cooling space 93 and a second cooling space 91 are formed, which make it possible to cool the platform 71 optimally in the region between the second turbine blade 65 and the first turbine blade 63. Thus, a platform edge design which is otherwise normally complicated to configure can, in connection with the further abutment 85, have a simpler configuration without any thermally high-risk region. To assist the cooling in the cooling spaces 91, 93, the carrying structure 95, 97 of the turbine blades 65, 63 which starts from the foot of the blade leaf 67, 69 is continued with an optimized configuration toward the blade foot 35, 47 in FIG. 1.

The sealing action, provided particularly at the further abutment 85, of the second sheet metal part 77 and of the first resilient elastic sheet metal part 79 arises, depending on the type of operation of the first turbine blade 63 and of the second turbine blade 65, preferably in the form of a guide blade 21 shown in FIG. 1 or, if appropriate, also in the form of a moving blade 23 shown in FIG. 1.

During the rotary operation of a turbine blade 65, 63 in the form of a moving blade 23 on a turbine rotor 19, to be precise, a centrifugal force acting from the foot of the blade leaf 67, 69 in the direction 99 of the blade leaf 67, 69 is generated as a result of rotation. A pressure drop, in the case of a guide blade 21, also occurs in addition. It is also conceivable that the first resilient elastic sheet metal part 79 lies sealingly against the further abutment 85 by means of a prestress self-generated by the first resilient elastic sheet metal part 79. The pressing force generated by the pressure drop can thereby be intensified.

During the operation of a turbine blade 65, 63 in the form of a guide blade 21, shown in FIG. 1, on a peripheral turbine casing 15, a pressure drop from the foot of the blade leaf 67, 69 in the direction 99 of the blade leaf 67, 69 is generated from the rear side 89 of a platform 71 by a cooling medium. The direction 99 of an abovementioned centrifugal force for a moving blade 23 also the direction 99 of the pressure drop for a guide blade 21 are identified in FIG. 2 by an arrow. Depending on the design of the turbine blade 67, 69 as a moving blade 23 or as a guide blade 21, therefore, the platform 71 in the form of the resilient elastic sheet metal parts 77, 79 is pressed against the further abutment 85 by means of the centrifugal force or by means of the pressure drop. In this way, the sheet metal parts 77, 79 of the platform 71 are fastened by centrifugal force or fastened by pressure and at the same time deploy their sealing action and separating action between the flow duct 5, acted upon by hot gas, and the rear side 89, acted upon by cooling medium, of the platform 71.

In summary, in order to configure a boundary 87 of a flow duct 5 of a gas turbine 1 as simply as possible, in the case of a turbine blade 63, 65 with a blade leaf 67, 69 arranged along a blade axis 73, 75 and with a platform region 61 which, arranged at the foot of the blade leaf

67, 69, has a platform 71 extending transversely with respect to the blade axis 73, 75, it is proposed that the platform 71 be formed by a sheet metal part 77, 79 fixed to the blade leaf 67,69. This also applies to a gas turbine 1 with a flow duct 5 extending along an axis 3 of the gas turbine 1 and having an annular cross section for a working medium M, and with a second blade stage 9, 13 arranged downstream of a first 7, 11 along the axis 3, a blade stage 7, 9, 11, 13 having a number of annularly arranged turbine blades 63, 65 extending radially into the duct 5, according to the above concept.

The invention claimed is:

1. A turbine blade, comprising:

a blade leaf arranged along a blade axis having a blade tip, a root opposite the tip, a suction side and a pressure side;

a platform region arranged at the root of the blade leaf; and a platform arranged at the platform region having a width and extending transversely with respect to the blade axis and partially formed by a first sheet metal component secured to a first abutment arranged on the blade leaf such that the first sheet metal component forms a seal when installed between the first abutment and a second abutment arranged on an axially adjacent turbine blade, wherein the first abutment and the second abutment are each configured as a radial groove protruding in an axial direction of the rotor sufficient to resist an operative radial force of the respective first sheet metal component and the second sheet metal component.

2. The turbine blade as claimed in claim 1, wherein the first sheet metal component is resilient and elastic.

3. The turbine blade as claimed in claim 2, wherein the second abutment is arranged directly on an adjacent turbine blade.

4. The turbine blade as claimed in claim 3, wherein the platform comprises a second sheet metal component secured to a third abutment arranged on a side of the blade leaf opposite that of the first abutment.

5. The turbine blade as claimed in claim 4, wherein the second sheet metal component is formed from a resilient elastic material.

6. The turbine blade as claimed in claim 5, wherein each abutment is a groove or edge.

7. The turbine blade as claimed in claim 1, wherein the second abutment is a bearing support.

8. The turbine blade as claimed in claim 1, wherein the first component is not secured to the second abutment when the turbine is not operational.

9. The turbine blade as claimed in claim 1, wherein during the rotary operation of a rotating turbine blade a self-generated centrifuigal force acting radially outward along the blade axis is generated as a result of the blade rotation and the first sheet metal component is pressed against the second abutment by the self-generated force.

10. The turbine blade as claimed in claim 1, wherein the platform region has a blade foot as a load-bearing structure.

11. A gas turbine, comprising:

a flow duct extending along an axis of the turbine having an annular cross section for a working medium; and a plurality of blade stages having a plurality of annularly arranged turbine blades that extend radially into the flow duct arranged one after another along the axis of the turbine, wherein each turbine blade comprises:

a blade leaf arranged along a blade axis having a blade tip, a foot opposite the tip, a suction side and a pressure side;

a platform region arranged at the foot of the blade leaf; and a platform arranged at the platform region having a width and extends transversely with respect to the blade axis and partially formed by a first resilient and elastic material secured to a first abutment arranged on the blade leaf such that the first resilient elastic component forms a seal when installed between the first abutment and a second abutment arranged with an axially adjacent turbine blade, wherein the first abutment and the second abutment are each configured as a radial groove protruding in an axial direction of the rotor sufficient to resist an operative radial force of the respective first sheet metal component and the second sheet metal component.

12. The gas turbine as claimed in claim 11, wherein the first resilient elastic material is formed from sheet metal.

13. The gas turbine as claimed in claim 11, wherein, during the rotary operation of a rotating turbine blade a centrifugal force acting from the foot of the blade leaf in the direction of the blade leaf is generated as the result of blade rotation, the first resilient elastic material is pressed against the second abutment by the centrifugal force is fastened to the second abutment by the centrifugal force.

14. The gas turbine as claimed in claim 11, wherein during the operation of a stationary turbine blade in the form of a stationary guide blade, a pressure drop from the foot of the blade leaf acting in the direction of the blade leaf is generated by a cooling medium, the first resilient elastic material is pressed against the second abutment by the pressure drop and is fastened against the second abutment by the resulting pressure.

15. The gas turbine as claimed in claim 11, wherein the first resilient elastic material operatively functions as a sealing element.

16. The gas turbine as claimed in claim 11, wherein a continuous boundary of the flow duct is formed between a first turbine blade and an adjacent second turbine blade of the same blade stage by the first resilient elastic component of the first turbine blade and by a second resilient elastic material of a second turbine blade.

17. The gas turbine as claimed in claim 16, wherein the first and second resilient elastic materials are formed from sheet metal.

18. The gas turbine as claimed in claim 11, wherein a continuous boundary of the flow duct is formed between a first turbine blade of the first blade stage and a second turbine blade of a second blade stage axially adjacent to the first turbine blade, by the first resilient elastic material of the first turbine blade and by a second resilient elastic material of a second turbine blade.

19. The gas turbine as claimed in claim 11, wherein a first resilient elastic material arranged on a first turbine blade and a second resilient elastic material arranged on a second turbine blade are both secured at a further abutment of either the first or second turbine blades.

20. A turbine blade, comprising:

a blade airfoil section arranged along a blade axis having a blade tip, a root opposite the tip, a pressure side and a suction side opposite the pressure side;

a platform region arranged at the root of the blade leaf; and a platform arranged at the platform region having a width and extending transversely with respect to the blade axis and partially formed by a first bendable metal component secured to a first abutment arranged on the blade leaf such that the sheet metal component forms a seal when installed between the first abutment and a second abutment arranged on an axially adjacent turbine blade, wherein the first abutment and the second abutment are each configured as a radial groove protruding in an axial direction of the rotor sufficient to resist an operative radial force of the respective first sheet metal component and the second sheet metal component.

* * * * *

UNITED STATES PATENT AND TRADEMARK OFFICE

CERTIFICATE OF CORRECTION

PATENT NO. : 7,607,889 B2
APPLICATION NO. : 10/586462
DATED : October 27, 2009
INVENTOR(S) : Baldauf et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 532 days.

Signed and Sealed this

Twelfth Day of October, 2010

David J. Kappos

David J. Kappos
*Director of the United States Patent and Trademark Office*